US007971329B1

(12) United States Patent
Brohard

(10) Patent No.: US 7,971,329 B1
(45) Date of Patent: Jul. 5, 2011

(54) HINGE PIN REMOVAL TOOL

(76) Inventor: John Brohard, Kent, WA (US)

( * ) Notice: Subject to any disclaimer, the term of this patent is extended or adjusted under 35 U.S.C. 154(b) by 456 days.

(21) Appl. No.: 12/167,941

(22) Filed: Jul. 3, 2008

(51) Int. Cl.
*B25B 27/11* (2006.01)

(52) U.S. Cl. ..... 29/275; 29/270; 254/131; D8/89; 7/138; 7/170

(58) Field of Classification Search ..... 29/275, 29/278, 270; 254/131; D8/16, 89; 7/138, 7/170
See application file for complete search history.

(56) References Cited

U.S. PATENT DOCUMENTS 3,602,969 A 9/1971 Provost
4,188,701 A 2/1980 Ludwig
5,435,030 A * 7/1995 Phillips ..... 7/138
5,875,535 A * 3/1999 Canoy ..... 29/275
D410,178 S * 5/1999 Clayson ..... D8/16
D419,848 S * 2/2000 Kirby ..... D8/89
6,308,390 B1 * 10/2001 Sullivan ..... 29/275
6,351,881 B1 * 3/2002 Peckich et al. ..... 29/275
6,742,415 B2 * 6/2004 Scott ..... 81/15.9
7,143,491 B2 12/2006 Wood
D568,124 S * 5/2008 Stevens, Sr. ..... D8/14
D589,313 S * 3/2009 Engelke ..... D8/40
2006/0123611 A1 * 6/2006 Wood ..... 29/275

* cited by examiner

*Primary Examiner* — Lee D Wilson

(57) ABSTRACT

A disclosed pin removal tool includes an elongate shank with a lift member extending orthogonally from a shank first end and a cylindrical shaft extending orthogonally from a shank second end, and also orthogonal to the lift member. The lift member has a blunt end fork with a pair of tongs forming a channel therebetween opening at a lift member distal end away from the shank.

7 Claims, 2 Drawing Sheets

HINGE PIN REMOVAL TOOL

BACKGROUND

1. Field of the Invention

This invention relates to tools for the removal of hinge pins, and more specifically to a tool that safely removes a hinge pin removal tool without damage to woodwork or hardware.

2. Prior Art

Difficulty experienced in removing door hinge pins is well known. A door may need to be removed so the homeowner or workman must remove the pins from the door hinges. The installed pin is in the hinge with only the bulbous head exposed except that the pin end opposite the head is accessible from below the hinge though it does not extend from the hinge. Access to the pin is at least limited. The difficulty in removing the pin may be worsened if the pin has not been removed for an extended period of time.

There are a number of tools known in the art designed to remove the pin in view of the difficulties. Some tools are designed to attempt to wedge the tool under the pin head by hammering the tool at the pin head to force the tool under the pin head and in doing so pry the pin head up from the hinge. This approach will almost always mar the hinge or the pin or both. Hammering against the pin also transmits the hammer blow to the hinge and then also to screws between the hinge and the door and door frame, which may damage the screws and the door and door frame. These screws and door and door frame were not designed to absorb lateral blows. And as force is applied in the wedging process, it is common for the tool to slip and mar nearby woodwork. Some form of pliers may also be employed, but again, the result is damage to the hinge and pin.

It is also known to drive a screwdriver or punch into the pin end from the bottom of the hinge and up through the hinging members through which the pin passes. This procedure will likely loosen the pin from the hinge, raising the head a small distance above the hinge at the top of the hinge but a tool is still needed to further and fully remove the pin from hinging members. Use of multiple tools are also inconvenient.

Tools have been proposed that employ a fork on one end to wedge or fit between the pin head and the hinge and on the other end a cylindrical shaft sized to fit into the bottom of the hinge. These tools may be generally effective but they risk scarring nearby woodwork or injuring the workman. For example, as one end is being used, the other end is aimed at the workman. Typically, the tool also requires the workman to hammer the shaft into the bottom of the shaft at a position opposite the shaft, which again is very close to the nearby woodwork, which is likely to damage the woodwork if the hammer should slip, or the like. Even if such mishaps should be unusual, even a single incidence is too many.

SUMMARY

The pin removal tool disclosed herein eliminates or at least greatly reduces such occurrences as described above. Damage to costly hardware and costly woodwork is avoided.

The disclosed pin removal tool includes an elongate shank with a lift member extending orthogonally from a shank first end and a cylindrical shaft extending orthogonally from a shank second end, and also orthogonal to the lift member. Thus when the shaft is vertical for insertion up through the hinge bottom, the lift member is parallel to a closed door attached to the hinge and therefore not aimed either at the door or the workman. Similarly, when the lift member engages the pin at the hinge top the shaft is parallel to the closed door to avoid marring the door or injuring the workman.

Unlike some combination tools, the lift member of the present invention is not of wedge shape but rather the lift member top and bottom are parallel, rather than tapered, for tool strength to sustain repeated hammer blows to the tool transmitted through the lift member to the hinge pin. The lift member has a blunt end fork with a pair of tongs forming a channel therebetween opening at a lift member distal end away from the shank. In use then the shaft, extending from the shank, is inserted into the bottom of the hinge and against the hinge pin bottom. A hammer then strikes the shank between shank ends and specifically away from the shank end and therefore away from the shaft and nearby woodwork to minimize the hammer striking the woodwork while driving the pin or striking the woodwork should the hammer slip from the tool while striking it.

DETAILED DESCRIPTION OF THE PREFERRED EMBODIMENT

Figure 1:
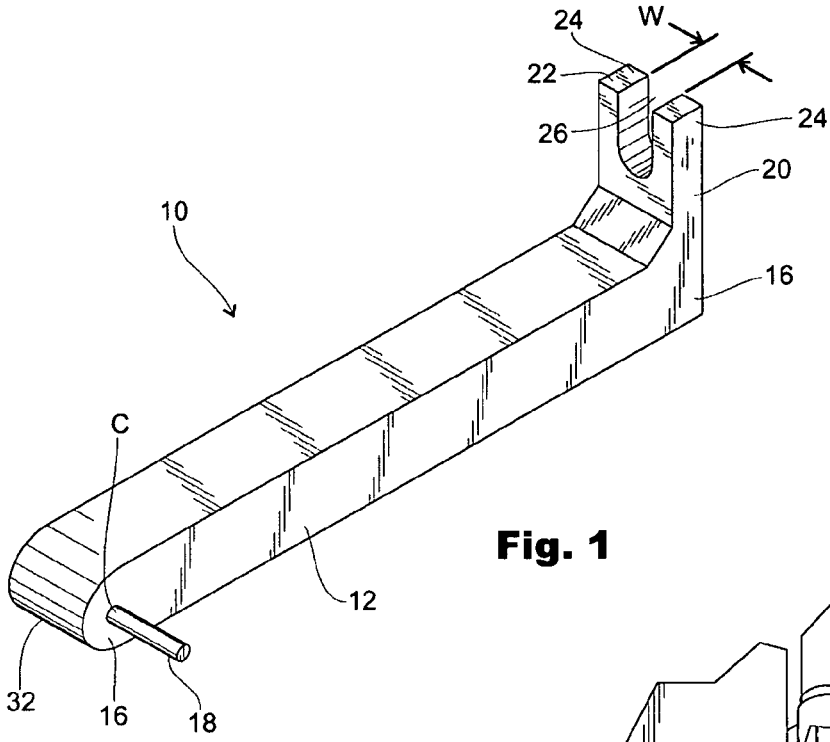
FIG. 1 is a perspective view of the combination tool of the present invention.
Figure 2:
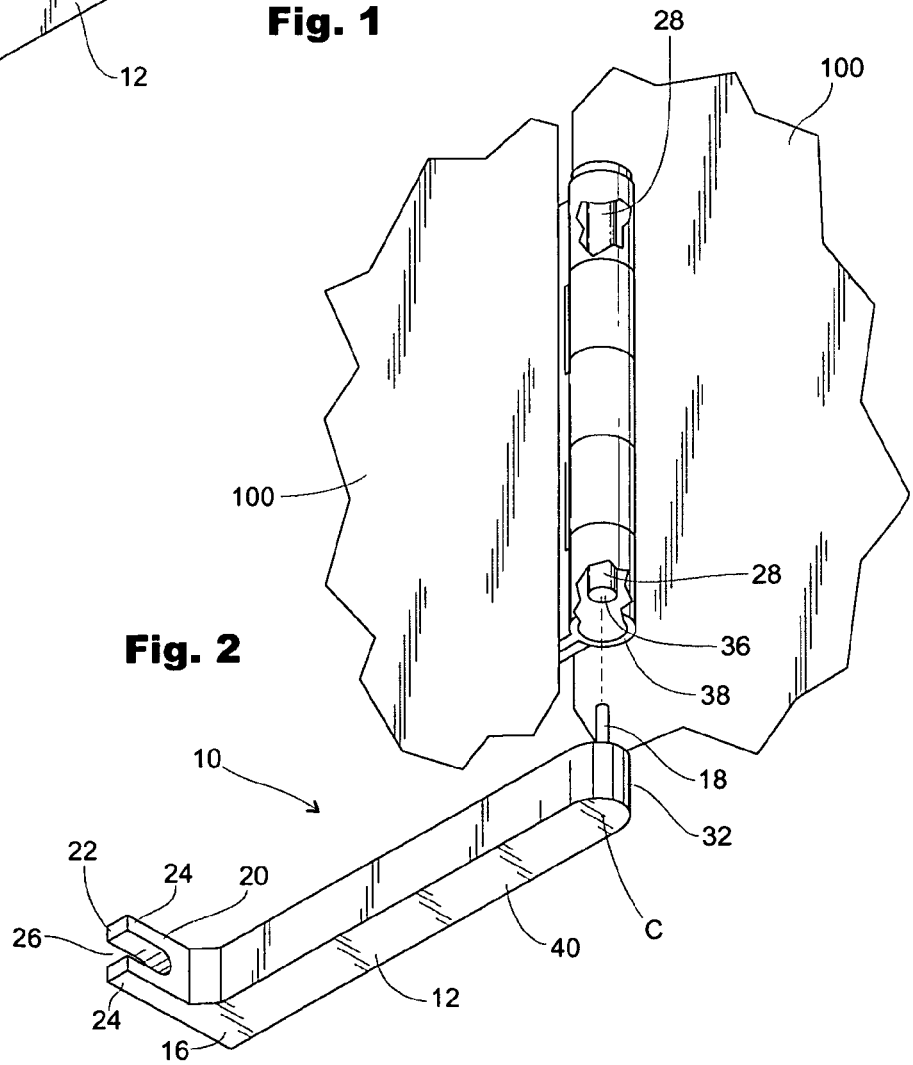
FIG. 2 is a perspective view of the tool of FIG. 1 shown in position to insert its shaft into the hinge from the hinge bottom.
Figure 3:
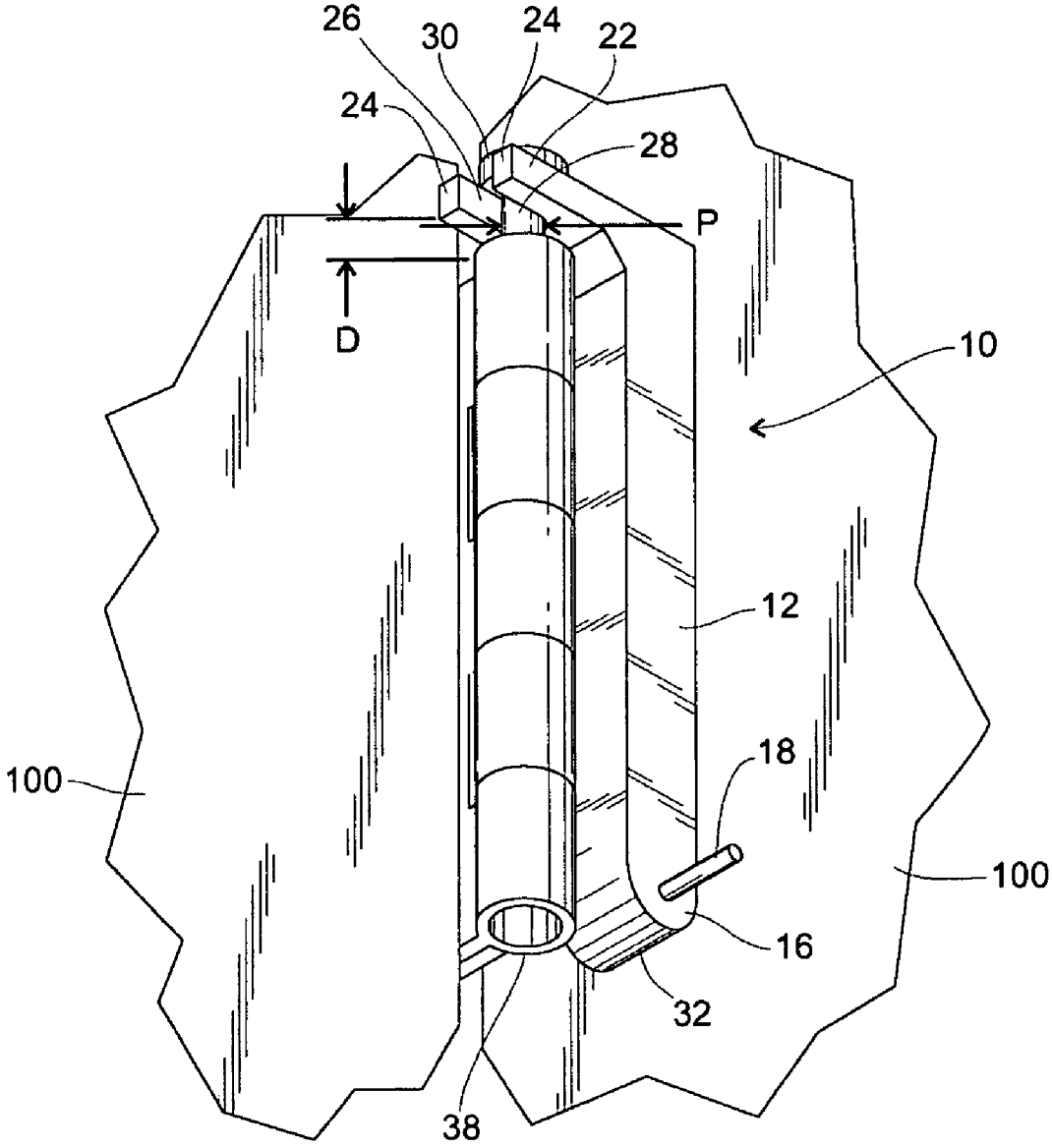
FIG. 3 is a perspective view of the tool of FIG. 1 shown in position in alignment for insertion about the hinge pin with the tool lift member between the hinge and the raised hinge pin head.

The combination hinge pin removal tool 10 of the present invention comprises an elongate shank 12 with first and second ends 14, 16 and a tool shaft 18 extending from the shank first end 14 generally orthogonal thereto. A lift member 20 extends from the second shank end 16 generally orthogonal thereto. The lift member 20 is also orthogonal to the tool shaft 18, the shank 12, the lift member 20 and the shaft 18 then extending in three mutually orthogonal directions.

The lift member 20 further comprises a forked end 22 having a pair of tongs 24 generally orthogonal to the shank 12 and also orthogonal to the tool shaft 18. The tongs 24 are spaced apart to form a channel 26 therebetween opening away from the shank 12 to receive a hinge pin 28 therein such that when the hinge pin 28 is vertical in the channel 26 the shank 12 is also generally vertical and parallel to the hinge pin 28. The channel 26 is of width W greater than a hinge pin width P but less than a hinge pin head 30 such that with the pin 28 in the channel 26 a hammer blow to an impact area at the longitudinal end 32 of the shank 12 at shank first end 14 longitudinal with the shank 12 moves tongs 24 of the lift member 20 against the pin head 30 and urges the pin 28 out of hinge 34.

The lift member 20 does not wedge between the pin head 30 and the hinge 34. Rather the pin 28 is urged up a distance D out of the hinge 34 by the tool shaft 18 being placed in the hinge 34 against the pin end 36 at the hinge bottom 38. In practice, said distance D is greater than the thickness of the lift member tongs which allows the tongs 24 to slip alongside the pin 28 under the head 30 with the pin 28 in the channel 26. Because the tongs 24 are not required to wedge between the pin head 30 and the hinge 34, marring to the pin and pin head is prevented. Also, because the tongs 24 are not required to wedge between the pin head and the hinge, a lift member top

37 is parallel to a lift member bottom 39 at the lift member forked end 22 for strength of the tongs 24. With the lift member 20 orthogonal to the shank 12 at the forked end 22, the shank 12 is vertical and parallel to the hinge 34 and hinge pin 28 for stability of the tool 10 as it receives the hammer blow.

The shank side 40 opposite the tool shaft 18 is a continuously flat surface between shank ends 14, 16, or at least a substantial distance from the shank first end, adapted to receive a hammer blow anywhere along said shank side 40. A hammer blow on the flat surface of said shank side 40 typically away from the shank first end 14 urges the pin 28 upward said distance D out of the hinge 34 while maintaining the hammer away from woodwork 100 to which the hinge 34 attaches to prevent damage to the woodwork 100 should the hammer slip or miss aim. The shank 12 is longer than the hinge 34 such that it extends below the hinge 34 when the pin 28 is in the lift member channel 26 such that the hammer blow is also below the hinge bottom 38 and not alongside the hinge 34 to prevent damage to the hinge 34. With the lift member 20 oriented orthogonal to the woodwork 100 to which the hinge 34 is attached with the hinge pin 28 in the channel 26, the shaft 18 is parallel to that woodwork 100, also to prevent damage to the woodwork 100.

Also to prevent damage to the woodwork 100, the tool shaft 18 is close to the shank first end 14 such that the shank 12 does not extend substantially beyond the shaft 18, maintaining the tool 10 a maximum distance from the woodwork 100. The shank first end 14 is semi-circular with its diameter that of the shank width S and with the tool shaft at its center C to allow the shaft 18 to access the hinge pin 28 at the hinge bottom 38 at an angle not necessarily orthogonal to the woodwork 100 without exposing a tool edge to the woodwork 100.

Having described the invention, what is claimed is as follows:

1. A combination hinge pin removal tool comprising:

an elongate shank with first and second ends, a tool shaft extending from the shank first end generally orthogonal thereto, and the tool shaft is a continuously flat surface at least a substantial distance from the shank first end, adapted to receive a hammer blow anywhere along said shank side, a lift member extending from the second shank end generally orthogonal thereto and also orthogonal to the tool shaft, the lift member further comprising a forked end having a pair of tongs generally orthogonal to the shank and also orthogonal to the tool shaft, the tongs spaced apart to form a channel therebetween opening away from the shank to receive a hinge pin therein such that when the hinge pin is vertical in the channel the shank is also generally vertical and parallel to the hinge pin and wherein said lift member includes a top parallel to a bottom at said forked end.

2. The tool of claim 1 wherein said shank side is continuously flat between shank ends.

3. The tool of claim 1 wherein the tool shaft is close to the shank first end such that the shank does not extend substantially beyond the shaft.

4. The tool of claim 3 wherein the shank first end is semi-circular with its diameter that of the shank width and with the tool shaft at its center.

5. A combination hinge pin removal tool comprising:

an elongate shank with first and second ends, a tool shaft extending from the shank first end orthogonal thereto, wherein the shank side opposite the tool shaft is a continuously flat surface between shank ends, adapted to receive a hammer blow anywhere along said shank side, a lift member extending from the second shank end orthogonal thereto and also orthogonal to the tool shaft, the lift member further comprising a forked end having a pair of tongs orthogonal to the shank and also orthogonal to the tool shaft, the tongs spaced apart to form a channel therebetween opening away from the shank to receive a hinge pin therein such that when the hinge pin is vertical in the channel the shank is also vertical and parallel to the hinge pin, the lift member having a top parallel to a bottom at said forked end.

6. A combination hinge pin removal tool comprising:

an elongate shank with first and second ends, a tool shaft extending from the shank first end generally orthogonal thereto, wherein the shank side opposite the tool shaft is a continuously flat surface between shank ends, adapted to receive a hammer blow anywhere along said shank side, wherein the tool shaft is close to the shank first end such that the shank does not extend substantially beyond the shaft, a lift member extending from the second shank end orthogonal thereto and also orthogonal to the tool shaft, the lift member further comprising a forked end having a pair of tongs orthogonal to the shank and also orthogonal to the tool shaft, the tongs spaced apart to form a channel therebetween opening away from the shank to receive a hinge pin therein such that when the hinge pin is vertical in the channel the shank is also vertical and parallel to the hinge pin and wherein said lift member includes a top parallel to a bottom at said forked end.

7. The tool of claim 6 wherein the shank first end is semi-circular with its diameter that of the shank width and with the tool shaft at its center.

* * * * *